US006003855A

United States Patent [19]

Beaufort et al.

[11] Patent Number: 6,003,855

[45] Date of Patent: Dec. 21, 1999

[54] MULTIPLE MEDIA SHEET STACK SELECTION MECHANISM

[75] Inventors: Richard F. Beaufort, Boise; Robin P. Yergenson, Eagle, both of Id.

[73] Assignee: Hewlett-Pakcard Company, Palo Alto, Calif.

[21] Appl. No.: 08/951,613

[22] Filed: Oct. 16, 1997

[51] Int. Cl.[6] ..... B65H 3/44; B65H 5/26

[52] U.S. Cl. ..... 271/9.02; 271/9.08

[58] Field of Search ..... 271/9.01, 9.02, 271/9.04, 9.08, 9.11, 9.13

[56] References Cited

U.S. PATENT DOCUMENTS

| | | | |
|---|---|---|---|
| 3,989,236 | 11/1976 | Komori et al. | 271/9.08 |
| 4,991,830 | 2/1991 | Yamanaka | 271/9.08 |
| 5,391,009 | 2/1995 | Stodder | 271/9.13 |

FOREIGN PATENT DOCUMENTS

| | | | |
|---|---|---|---|
| 361188336A | 8/1986 | Japan | 271/9.08 |

*Primary Examiner*—H. Grant Skaggs

*Attorney, Agent, or Firm*—Matthew L. Wade

[57] ABSTRACT

A multiple media sheet stack selection mechanism for selectively presenting multiple media sheet stacks to the same sheet separation and feed mechanism. The multiple media stack selection mechanism includes a primary sheet holder and at least one secondary stack holder. In the first embodiment, the multiple media stack selection mechanism includes a rotatable feed arm mechanism for holding the second paper stack and for positioning the second paper stack for picking and advancement. In the second embodiment, the multiple media sheet stack selection mechanism includes a paper stack gripping device for holding a second paper stack and for positioning the second paper stack for picking and advancement. In both the first and second embodiment, the paper stacks are positioned at a near vertical angle. The near vertical angle provides additional advantages in that the gravity force assists in constantly urging the sheets toward the feed zone, and results in a greater feed reliability. In the third embodiment, the multiple stack selector includes two tray mechanisms that selectively position two separate stacks of paper to the same picking and advancement device by the use of a dual cam and associated cam follower arrangement.

6 Claims, 4 Drawing Sheets

MULTIPLE MEDIA SHEET STACK SELECTION MECHANISM

FIELD OF THE INVENTION

This invention relates to a cut sheet feed mechanism for use with image recording machines and, more particularly, to a media feeding mechanism for selectively presenting multiple media sheet stacks to the same sheet picking and advancement mechanism.

BACKGROUND OF THE INVENTION

It is often desirable for a printer or copier to have capability to selectively print on multiple media types. Further, it is desirable to selectively print on multiple media types without having to reload the printer each time a different media type is selected for printing. As a result, a generally desired printer or copier (printer/copier) feature is the ability to automatically select and feed from multiple media sheet stacks stored in the printer.

Unfortunately this feature adds to the cost of a printer/copier if each media sheet stack has an associated sheet picking and advancement mechanism. This added cost is especially prohibitive for less expensive or "low-end" printers/copiers as the added increase in cost of an additional sheet picking and advancement mechanism is a large percentage of the overall cost of the printer/copier. As a result, the capability of a printer/copier to hold and print from multiple media sheet stacks is correspondingly limited.

SUMMARY OF THE INVENTION

Accordingly, it is an object of this invention to provide the capability to hold and selectively present multiple media sheet stacks for picking and advancement to the same sheet picking and advancement mechanism.

This and other objects and advantages are achieved by the inventive multiple media sheet stack selection mechanism (multiple stack selector). Three exemplary embodiments of the multiple stack selector are described. In all three embodiments the multiple stack selector is illustrated for use in a laser printer having a single media picking and advancement mechanism. In the first embodiment, the multiple stack selector includes a rotatable feed arm mechanism for holding a second paper stack and for positioning the second paper stack for picking and advancement. In the second embodiment, the multiple stack selector includes a paper stack gripping device for holding a second paper stack and for positioning the second paper stack for picking and advancement.

In the third embodiment, the multiple stack selector includes two tray mechanisms that selectively position two separate stacks of paper to the same picking and advancement device by the use of a dual cam and associated cam follower arrangement.

DETAILED DESCRIPTION OF THE INVENTION

The present invention is a multiple stack selector for selectively presenting two or more media sheet stacks to a single media picking and advancement device. To illustrate various aspects of the invention, the multiple stack selector will be described for use in a low-end printer having a single media picking and advancement mechanism. In the first two embodiments, the low-end printer having two media sheet stacks maintained at a high angle. Also for illustration purposes, the media sheet stacks will consist of sheet paper. The multiple stack selector, however, is applicable more broadly to many types of printers/copiers. The multiple stack selector is also applicable for use with many types and sizes of media such as clear transparency film (typically used for presentations) and envelopes.

The multiple stack selector is described in three exemplary embodiments. In all three exemplary embodiments, the multiple stack selector provides capability to hold and selectively present either of two paper stacks to the same single sheet picking and advancement device for top-paper picking and advancement. The single sheet picking and advancement device is a rotatable sheet pick/feed mechanism (pick/feeder) well known in the art.

In the first two exemplary embodiments, top-paper separation from the associated paper stack is obtained by the use of a separation pad mechanism. In the third exemplary embodiment, top-paper separation from the associated paper stack is obtained by the use of corner separators.

For purposes of this illustration the terms "top-paper" and "first-paper" are used interchangeably. Both terms are used to indicate the outer sheet of a paper stack next inline for picking. A paper-stack properly oriented to the pick/feeder for top-paper picking is referred to herein as in the "pick zone".

Figure 1:
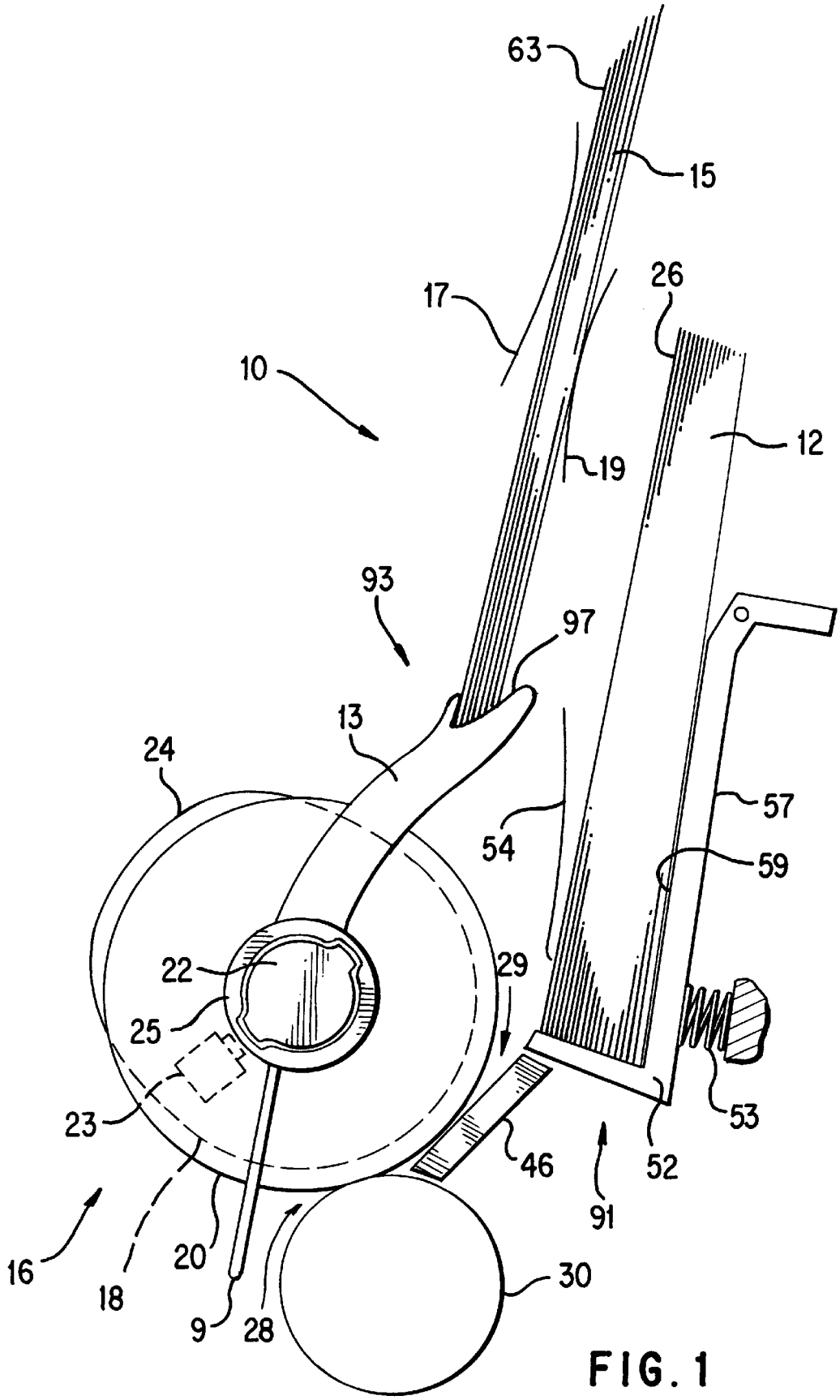
FIG. 1 is a sectional side view illustrating the first embodiment of the multiple stack selector.
Figure 2:
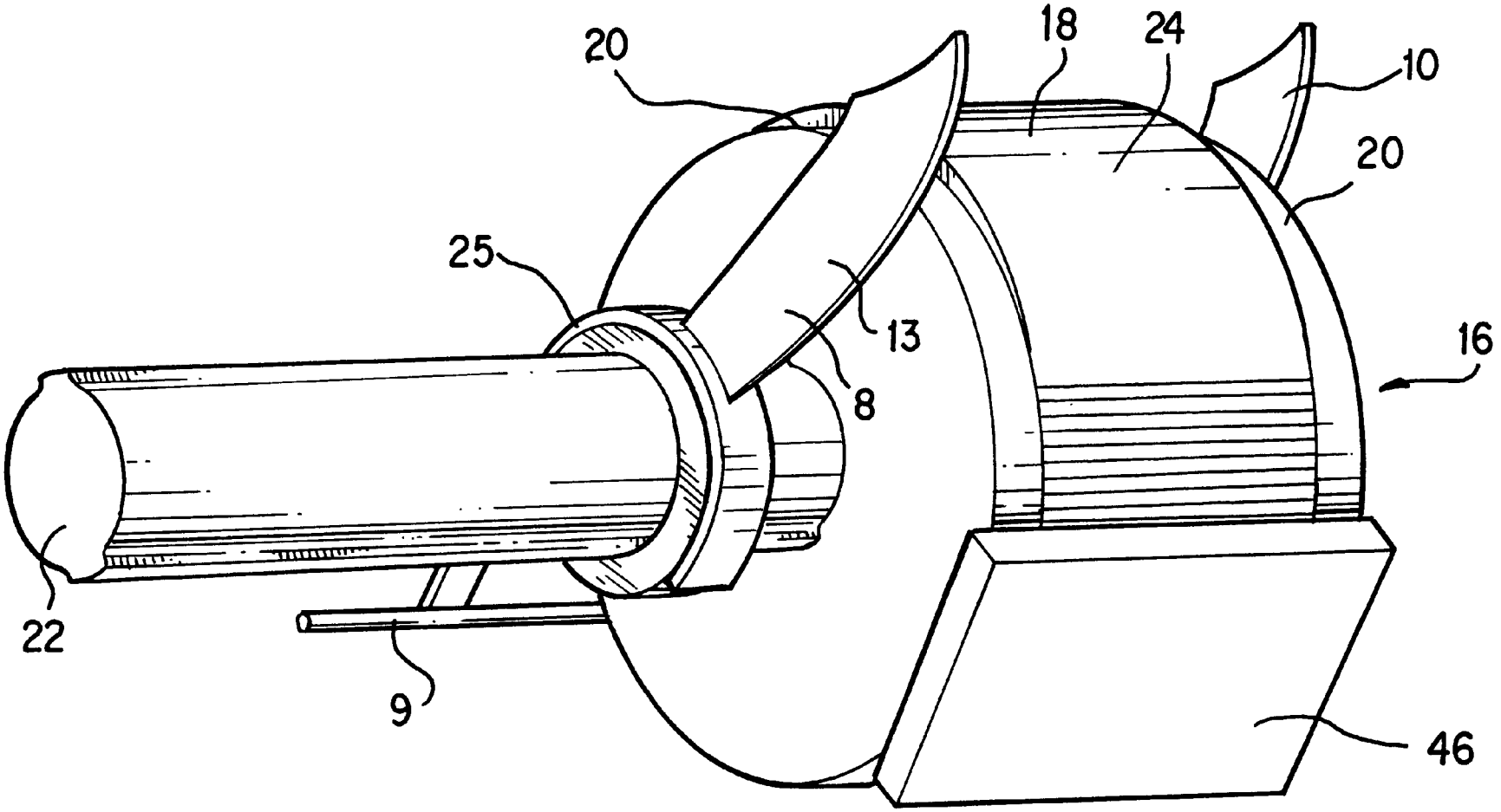
FIG. 2 is a perspective view illustrating the pertinent components of a printer paper feed system incorporating the multiple stack selector.

The first exemplary embodiment of the multiple stack selector is illustrated in FIG. 1 and FIG. 2. FIG. 1 is a sectional side view illustrating the components of multiple stack selector 10 and pick/feeder 16. Also shown in FIG. 1 is a first paper stack 12 and a second paper stack 15. FIG. 2 is a perspective view illustrating some of the pertinent components of multiple stack selector 10 and the relationship these components have to pick/feeder 16.

Pick/feeder 16 includes sheet pick roller 18, idler rollers 20, feed roller 30 and separator pad mechanism 46. Sheet pick roller 18 is mounted on and operatively coupled to shaft 22 for rotation therewith. Pick roller 18 includes a sheet picking surface 24 over a portion of its outer surface. The sheet picking surface 24 consists of material having a high coefficient of friction.

During a pick cycle and if (for example) first paper stack 12 is in the pick zone, sheet pick roller 18 rotates in a forward direction thereby rotating sheet picking surface 24 towards top sheet 26. As a result, sheet picking surface 24 of sheet pick roller 18 engages the upper surface of top sheet 26 and advances top sheet 26 through separation zone 29 and into feed zone 28. Idler rollers 20 are mounted on shaft 22 laterally adjacent to sheet pick roller 18. Feed roller 30, which is typically positioned beneath and immediately adjacent to one of the idler rollers 20, continues to advance top sheet 26 through feed zone 28 after top sheet 26 is released from sheet picking surface 24. Idler rollers 20 spin freely about shaft 22. A driver such as a stepper motor (not shown) rotatably drives shaft 22. Separator pad mechanism 46 is located in feed zone 29 and is closely adjacent to and beneath sheet pick roller 18. Separator pad mechanism 46 has an outer surface formed from a material having a high coefficient of friction. This outer surface is positioned to contact and retard further advancement of any sheets advancing with top sheet 26 though separation zone 29. The reader will appreciate pick/feeder 16 and separator pad mechanism 46 are both conventional and may be implemented in any suitable manner well known to those skilled in the art without departing from the present invention.

Multiple stack selector 10 includes a tray mechanism 91 for guiding and locating first paper stack 12, a feed arm mechanism 93 for guiding and locating paper stack 15 and a cam follower 54.

Tray mechanism 91 includes lift plate 52. Lift plate 52 having an inner receiving surface 59 for receiving and holding paper stack 12 and an outer surface 57. Lift plate 52 is pivotally mounted to printer chassis to properly position paper stack 12. A cam follower 54 is fixedly mounted to lift plate 52 and is shaped and positioned to cooperate with feed arm mechanism 93 to pivotally move lift plate 52 during the operation of multiple stack selector 10. The cooperation of feed arm mechanism 93 with cam follower 54 is discussed in more detail below.

Tray mechanism 91 further includes a return spring 53 (return mechanism). Return mechanism 53 has two operative ends. The first operative end is coupled to outer surface 57 of lift plate 52 and the second operative end is fixedly mounted to the printer chassis. Return mechanism 53 provides an urging force to lift plate 52 to move lift plate 52 towards pick/feeder 16 to position paper stack 12 in the pick zone for top-paper picking and advancement.

Feed arm mechanism 93 includes a feed arm frame 13, a wrap spring 25, a solenoid 23, an upper guide 17 and a lower guide 19. Upper guide 17 and lower guide 19 are fixedly mounted to printer chassis for guiding paper stack 15 during the operation of multiple stack selector 10.

Feed arm frame 13 includes a first arm section 10 and a second arm section 8. First arm section 10 and second arm section 8 are maintained substantially parallel and similarly oriented by a support member 9 connected therebetween. In addition, support member 9 maintains first arm section 10 and second arm section 8 a distance apart greater than the combined width of idler rollers 20 and sheet pick roller 18. This allows feed arm frame 13 to be positioned on shaft 22 (as shown in FIG. 2) and rotated with shaft 22 so as not to interfere with the operation of pick/feeder 16.

First arm section 10 and second arm section 8 each have an end section shaped appropriately to cooperate with the other for receiving and holding paper stack 15. In addition, each end section has an outer surface shaped appropriately for engaging cam follower 54 during the operation of feed arm mechanism 93.

As shown in FIG. 2, feed arm frame 13 is fixedly coupled to wrap spring 25 and rotates therewith. Wrap spring 25 is operatively coupled to shaft 22 and is positioned on shaft 22 to locate first arm section 10 and second arm section 8 on either side of pick/feeder 16.

Wrap spring 25 includes an internal clutch mechanism. If wrap spring 25 is "engaged" the internal clutch mechanism of wrap spring 25 is operative and as a result, wrap spring 25 remains stationary during the rotation of shaft 22. If wrap spring 25 is not engaged, wrap spring 25 rotates with shaft 22. Solenoid 23 is mounted to printer chassis and is positioned to controllably engage wrap spring 25 thereby controlling the rotation of feed arm 13 with shaft 22. Wrap spring 25 is conventional and well known to those skilled in the art.

The operation of the multiple stack selector 10 is described herein by referring to two phases of its operation: "secondary stack feed operation" and "primary stack feed operation". Previous to the secondary stack feed operation and as illustrated in FIG. 1, paper stack 12 is positioned in the pick zone by tray mechanism 91. In addition, paper stack 15 is maintained in a pre-feed position by the engagement of wrap spring 25 by solenoid 23. After every pick cycle, pick roller 18 is controlled to stop rotating so that sheet picking surface 24 is behind (with respect to forward rotation) first arm section 10 and second arm section 8 of feed arm frame 13. This initial condition of the secondary stack feed operation is illustrated in FIG. 1.

The secondary stack feed operation commences with a print job sent to the printer requiring printing on sheets from paper stack 15. As a result, a control signal is sent by the printer controller to solenoid 23 to disengage wrap spring 25. After wrap spring 25 is disengaged, shaft 22 is then rotated in a forward direction thereby rotating wrap spring 25, feed arm frame 13 and paper stack 15. In addition, pick roller 18 rotates with shaft 22. Due to their respective initial positions, feed arm frame 13 leads sheet picking surface 24 during forward rotation of shaft 22.

Also during forward rotation, the outer surfaces of the end sections of first arm section 10 and second arm section 8 engages cam follower 54 and overcomes the urging force from return mechanism 53 to move lift plate 52 and thereby move paper stack 12 away from the pick zone. As feed arm frame 13 continues to rotate and paper stack 12 is moved away from the pick zone, paper stack 15 is moved into the pick zone and comes to rest between paper stack 12 and the pick/feeder 16.

After paper stack 15 is positioned in the pick zone, and feed arm frame 13 is rotated further past the pick zone, wrap spring 25 is engaged by solenoid 23. As a result, feed arm frame 13 no longer rotates with shaft 22 and first arm section 10 and second arm section 8 are positioned so that feeding from paper stack 15 is unobstructed. However, sheet pick roller 18 continues to rotate and as a result, sheet picking surface 24 engages the upper surface of top sheet 63 and advances top sheet 63 through separation zone 29 and into feed zone 28. Any sheets advancing with top sheet 63 through separation zone 29 remain in separation zone 29 due to the advancement retarding effects of separator pad mechanism 46. Feed roller 30, continues to advance top sheet 63 through feed zone 28 after top sheet 26 is released from sheet picking surface 24 of sheet pick roller 18. While paper stack 15 is located in the pick zone, other sheets may be picked and advanced from paper stack 15. The respective positions of feed arm frame 13, paper stack 15 and paper stack 12 after the completion of the secondary stack feed operation is referred to herein as being in a "secondary feed position".

Previous to the primary stack feed operation feed arm 13, paper stack 15 and paper stack 12 is in the secondary feed position. The primary stack feed operation commences with a print job requiring printing on paper stack 12. As a result, a control signal is sent by the printer controller to solenoid 23 to disengage wrap spring 25. After wrap spring 25 is disengaged, shaft 22 is then rotated in a reverse direction thereby rotating wrap spring 25 and feed arm frame 13 in a reverse direction. As feed arm frame 13 is rotated past separator pad 46, paper stack 15 is lifted by first arm section 10 and second arm section 8 out of the pick zone and back into the pre-feed position. Wrap spring 25 is then engaged by solenoid 23. As a result, paper stack 15 remains positioned in the pre-feed position. In addition, as paper stack 15 is lifted into the pre-feed position, paper stack 12 moves into the pick zone due to the urging force of return mechanism 53. Shaft 22 is then rotated in a forward direction, thereby rotating sheet pick roller 18 in the forward direction to engage and feed a top sheet from paper stack 12.

Figure 3:
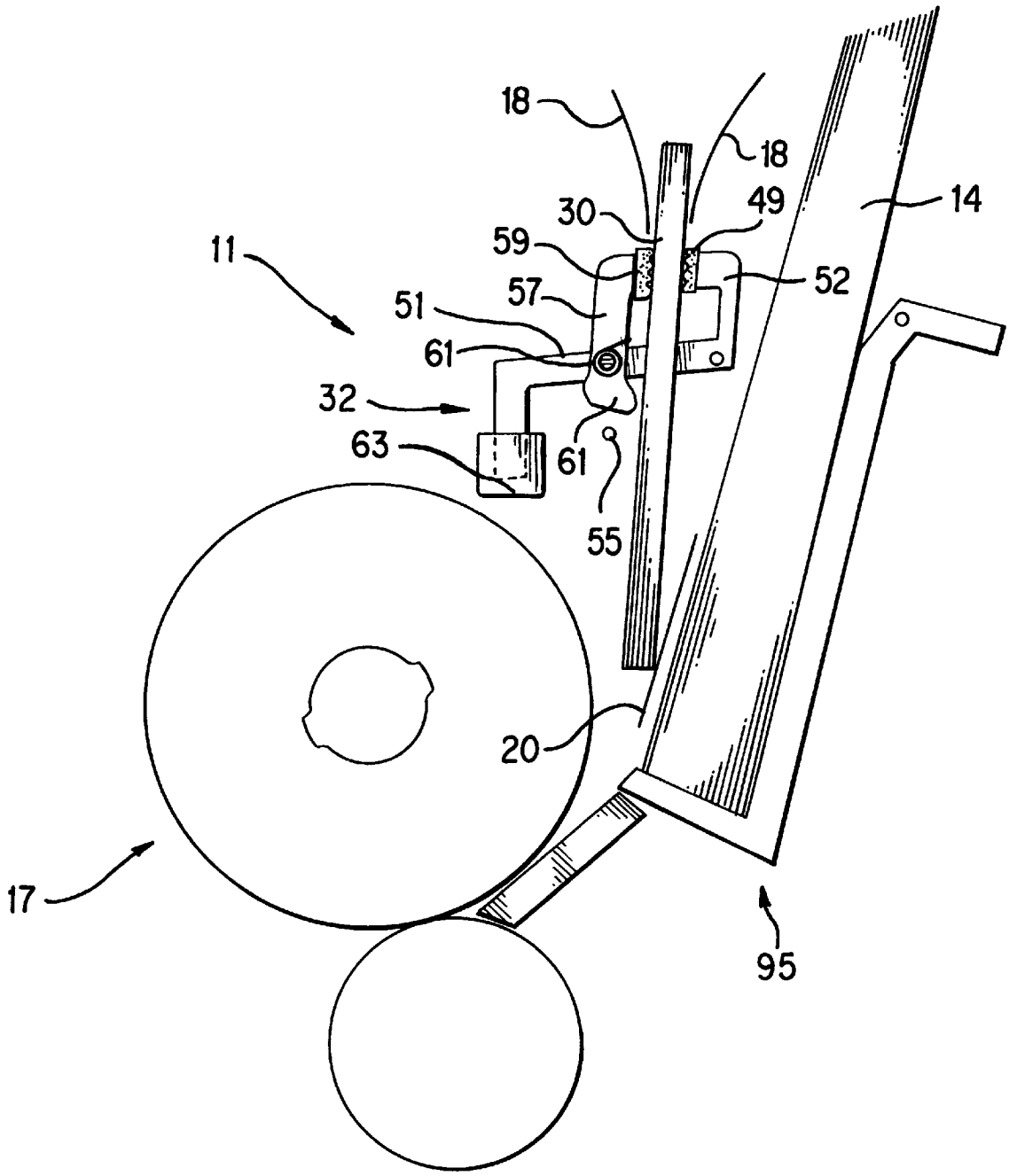
FIG. 3 is a sectional side view illustrating the second embodiment of the multiple stack selector.

The second exemplary embodiment of the multiple stack selector is illustrated in FIG. 3. FIG. 3 illustrates the components of multiple stack selector 11 and pick feeder 17. Pick/feeder 17 is similar in design and operates in a similar manner as pick/feeder 16 illustrated in FIG. 1 and FIG. 2. Also shown in FIG. 3 is a paper stack 14 and a paper stack 30.

Multiple stack selector 11 includes tray mechanism 95 for guiding and positioning paper stack 14, and lift mechanism 32 for guiding and positioning paper stack 30. Tray mechanism 95 is similar in design and in operation as tray mechanism 91 illustrated in FIG. 1.

Lift mechanism 32 includes a frame 51, a first grip pad 49, a second grip pad 59, a lever 57, a pin 55, a solenoid 63, a pair of upper guides 18 and a lower guide 20.

Frame 51 includes an arm section 52 extending at a predefined angle for mounting and positioning first grip pad 49. First grip pad 49 is mounted to the distal end of arm section 52 for providing a first surface for gripping paper stack 30. Second grip pad 59 is mounted to lever 57 as shown in FIG. 3.

Lever 57 is hingedly mounted to frame 51 for positioning second grip pad 59 between a "gripping position" and a "feeding permissive position". While in the gripping position, second grip pad 59 is located by lever 57 proximal to the first grip pad 49 for applying a holding force to paper stack 30 located therebetween. The holding force to paper stack 30 is generated by a spring 61 attached to frame 51 and lever 57. Spring 61 continuously provides an urging force to lever 57 to move second grip pad 59 towards first grip pad 49.

Frame 51 is operatively coupled at one end to solenoid 63 and pivotally mounted to printer chassis at the opposing end for moving frame 51 and thereby moving paper stack 30 between a pre-feed position and the pick zone. Pin 55 is mounted to printer chassis and positioned to engage lobe section 61 and thereby translate the movement of frame 51 as frame 51 moves paper stack 30 from the pre-feed position to the pick zone into corresponding pivoting movement of lever 57. The engagement of lobe section 61 by pin 55 as frame 51 moves paper stack 30 to the pick zone results in overcoming the urging force from spring 61 and rotates lever 57 thereby rotating grip pad 59 to the feeding permissive position, apart from paper stack 30. As a result, paper stack 30 is positioned in the pick zone and is free for top-paper picking and advancement by pick/feeder 16.

The operation of multiple stack selector 11 is described herein by referring to two phases of its operation: "paper drop operation" and "paper lift operation". Previous to the paper drop operation, paper stack 14 is positioned in the pick zone by tray mechanism 95. In addition, paper stack 30 is held between grip pad 59 and grip pad 49 in a pre-feed position by lift mechanism 32 and lever 57 (lever 57 is in a gripping position). This initial condition of the paper drop operation is illustrated in FIG. 3.

The paper drop operation commences with a print job sent to the printer requiring printing on sheets from paper stack 30. As a result, the printer controller sends a control signal to solenoid 63. Solenoid 63 responds by moving frame 51 and thereby moving paper stack 30 from a pre-feed position to the pick zone. As frame 51 moves paper stack 30 to the pick zone, lobe section 61 of lever 57 engages pin 55 and overcomes the urging force from spring 61 to cause grip pad 59 to move into the feed permissive position. Paper stack 30 is guided by guides 18 and lower guide 20 to come to rest in the pick zone between paper stack 14 and pick/feeder 17. Once paper stack 30 is positioned in the pick zone, top paper feeding from paper stack 30 is then accomplished by operation of pick/feeder 17.

The respective positions of lift mechanism 32 and paper stack 30 after the completion of the paper drop operation is the initial condition at the start of the paper lift operation. The paper lift operation commences with a print job sent to the printer requiring printing on sheets from paper stack 14. As a result, the printer controller sends a control signal to solenoid 63 to move frame 51 in an upward direction. As frame 51 moves in an upward direction, lobe section 61 is disengaged from pin 55 and lever 57 moves into a gripping position under the urging force of spring 61. With lever 57 in a gripping position, paper stack 30 is held between the grip pad 49 and the grip pad 59 and moved out of the pick zone. As paper stack 30 is moved out of the pick zone, paper stack 14 is moved back into the pick zone by tray mechanism 95.

Figure 4:
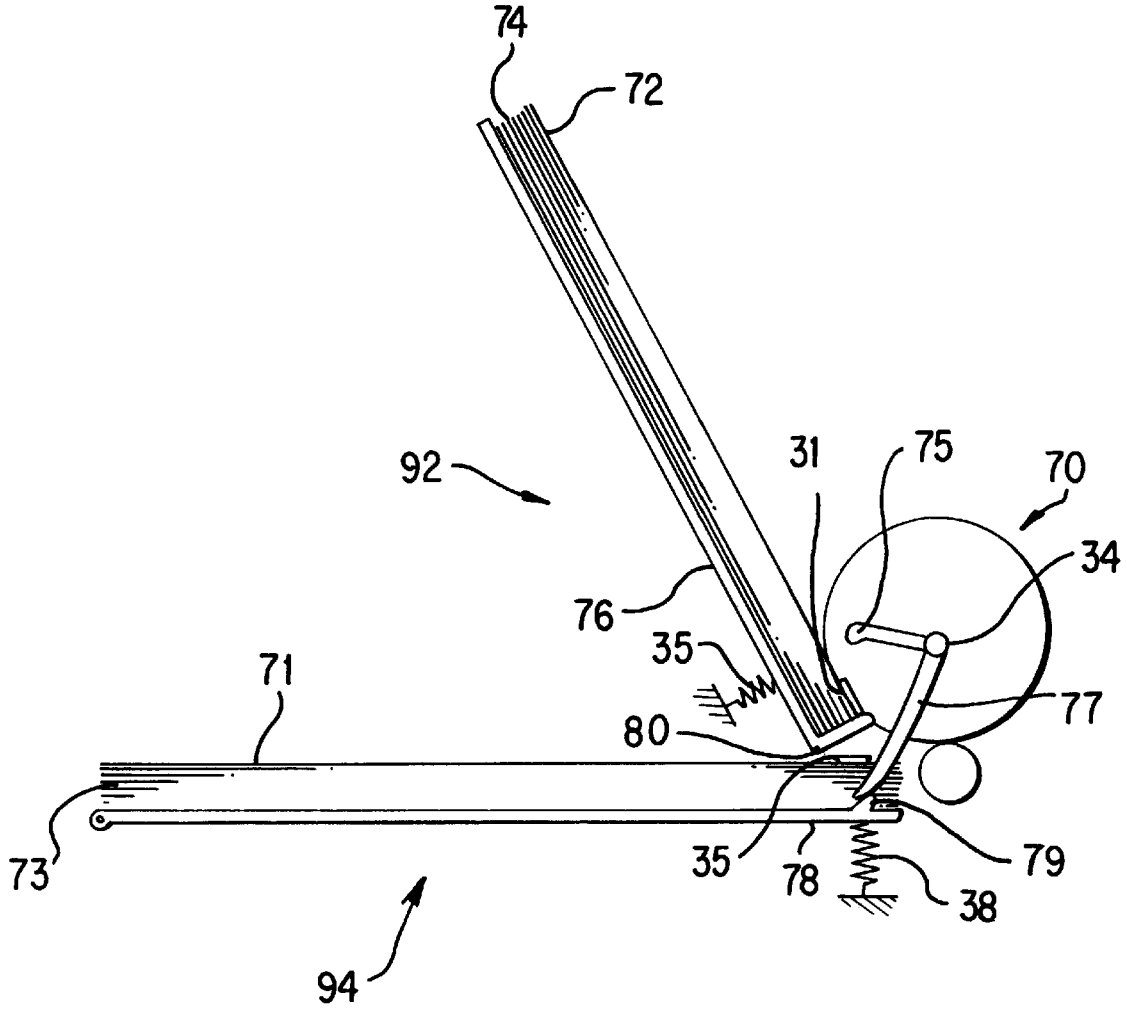
FIG. 4 is a sectional side view illustrating the third embodiment of the multiple stack selector.

In a further aspect of the first and second exemplary embodiments of the present invention, a clearing mechanism is included. One embodiment of the clearing mechanism is described in patent entitled: "Mechanism for avoiding multiple sheet misfeeds in media sheet feed systems" having U.S. Pat. No. 5,655,762. That patent is assigned to the same assignee as this application and is incorporated by reference herein as if set out in full. The clearing mechanism is used to automatically clear next-to-top sheets from the separator pad so that a sufficient frictional area of the pad remains exposed for separation during subsequent pick/feed cycles The third exemplary embodiment of the multiple stack selector is illustrated in FIG. 4. FIG. 4 is a sectional side view illustrating the components of the multiple stack selector and pick/feeder 70. As previously discussed above, pick/feeder 70 is well known in the art. The components of the multiple stack selector include a primary tray mechanism 92 for guiding and positioning paper stack 74 and a secondary tray mechanism 94 for guiding and positioning paper stack 73. Both tray mechanism 92 and secondary tray mechanism 94 are similar in design and operation to tray mechanism 91 illustrated in FIG. 1.

In this third exemplary embodiment, top-paper separation is obtained by the use of corner separators. Accordingly, attached to primary tray mechanism 92 is a first pair of corner separators 31. Also, attached to secondary tray mechanism 94 is a second pair of corner separators 35. The use of corner separators for paper separation is well known in the art.

The multiple stack selector further includes a primary cam 75, a secondary cam 77, a primary cam follower 80 and a secondary cam follower 79. Primary cam follower 80 is connected as shown to tray mechanism 92. Secondary cam follower 79 is connected as shown to tray mechanism 94. Both primary cam 75 and secondary cam 77 are operatively coupled to pick/feeder 70 for selective and controlled rotation.

Prior to feeding from paper stack 74, secondary cam 77 is rotated to engage cam follower 79, thereby moving tray mechanism 94 and paper stack 73 away from pick/feeder 70. As a result, paper stack 73 is positioned outside of the pick zone. In addition, primary cam 75 is rotated away from primary cam follower 80 to a nonengagement position. As a result of the urging force from the return mechanism associated with tray mechanism 92, the top paper of paper stack 74 is positioned for picking and advancement by pick feeder 70.

Similarly, prior to feeding from paper stack 73, primary cam 75 is rotated to engage cam follower 80, thereby moving tray mechanism 92 and paper stack 74 away from pick/feeder 70. As a result, paper stack 74 is positioned outside of the pick zone. In addition, primary cam 75 is rotated away from primary cam follower 80 to a nonengagement position. As a result of the urging force from the return mechanism associated with tray mechanism 94, the top paper of paper stack 73 is positioned for picking and advancement by pick feeder 70.

It is noted the first two exemplary embodiments of the multiple stack selector have particular advantages for a low-end printer having a small foot print. This results from the vertical or near vertical storage position of the paper trays. The vertical or near vertical high angle of paper feed provides additional advantages in that the gravity force assists in constantly urging the sheets toward the feed zone, and results in a greater feed reliability. The third exemplary embodiment has a particular advantage in that the secondary tray mechanism allows for a greater number of sheets to be stored and printed therefrom, due to the horizontal paper storage position, as compared to the first and second exemplary embodiment.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. Apparatus for selectively separating and advancing media sheets from a plurality of media sheet stacks into a sheet feeding zone, comprising:

(a) means, including a rotatable shaft and a sheet picking surface coupled to said shaft for rotation therewith, for picking a top-sheet from a media sheet stack located in a pick zone;

(b) a primary stack holder for retractably positioning a primary media sheet stack to said pick zone, and;

(c) means, selectably coupled to said shaft for rotation therewith, for holding a secondary media sheet stack and for moving said secondary media sheet stack from a first retracted position to said pick zone.

2. Apparatus as recited in claim 1, wherein said secondary stack holding and moving means includes a frame having a first and a second arm, each of said arms maintained substantially parallel and similarly oriented by a support member connecting said first and second arm and each of said arms having an end section adapted to receive and hold said secondary media sheet stack.

3. Apparatus as recited in claim 2, wherein said primary stack holder positions said primary media sheet stack in an angled position with the leading edges of said primary media sheet stack at a lower position than the trailing edges of said primary media sheet stack.

4. Apparatus as recited in claim 3, wherein said secondary stack holder positions said secondary media sheet stack in an angled position with the leading edges of said secondary media sheet stack at a lower position than the trailing edges of said secondary media sheet stack.

5. Apparatus as recited in claim 1, wherein said primary stack holder positions said primary media sheet stack in an angled position with the leading edges of said primary media sheet stack at a lower position than the trailing edges of said primary media sheet stack.

6. Apparatus as recited in claim 5, wherein said secondary stack holder positions said secondary media sheet stack in an angled position with the leading edges of said secondary media sheet stack at a lower position than the trailing edges of said secondary media sheet stack.

* * * * *